US008770833B2

(12) United States Patent
Sciascia et al.

(10) Patent No.: US 8,770,833 B2
(45) Date of Patent: Jul. 8, 2014

(54) REMOVABLE ACOUSTIC RADIATING MEMBRANE FOR A MUSICAL WATCH OR STRIKING WATCH AND WATCH INCLUDING THE SAME

(75) Inventors: Fabio Sciascia, L'Orient (CH); Jan Pittet, Le Sentier (CH); Beat Gilomen, Grenchen (CH); Dave Mangin, Orbe (CH)

(73) Assignee: Montres Breguet SA, L'Abbaye (CH)

( * ) Notice: Subject to any disclaimer, the term of this patent is extended or adjusted under 35 U.S.C. 154(b) by 96 days.

(21) Appl. No.: 13/424,650

(22) Filed: Mar. 20, 2012

(65) Prior Publication Data

US 2012/0243389 A1 Sep. 27, 2012

(30) Foreign Application Priority Data

Mar. 22, 2011 (EP) ..... 11159275

(51) Int. Cl.
*G04B 37/00* (2006.01)

(52) U.S. Cl.
USPC ..... 368/315

(58) Field of Classification Search
USPC ..... 368/72, 74, 315, 88, 250, 255, 276, 368/281, 286, 291, 309; 29/896.3
See application file for complete search history.

(56) References Cited

U.S. PATENT DOCUMENTS 2,786,326 A 3/1957 Junghans et al.
3,811,401 A * 5/1974 Piquerez ..... 116/270
6,014,347 A * 1/2000 Mignot et al. ..... 368/88
6,219,304 B1 * 4/2001 Mignot et al. ..... 368/88
8,322,916 B2 * 12/2012 Patt ..... 368/281

FOREIGN PATENT DOCUMENTS

| | | |
|---|---|---|
| CH | 224250 | 11/1942 |
| CH | 285202 | 8/1952 |
| CH | 11273/60 | 11/1963 |
| CH | 375664 | 11/1963 |

OTHER PUBLICATIONS

European Search Report issued Oct. 14, 2011, in Patent Application No. EP 11 15 9275 (With English-Language Translation).

* cited by examiner

*Primary Examiner* — Edwin A. Leon
(74) *Attorney, Agent, or Firm* — Oblon, Spivak, McClelland, Maier & Neustadt, L.L.P.

(57) ABSTRACT

The musical or striking watch includes a watch case, which is formed of a middle part and a back cover, provided with side apertures and removably secured in a sealed manner to the middle part. A crystal closes the case in a sealed manner. A timepiece movement is held inside the watch case and provided with a striking mechanism that can be actuated at determined times to produce notes or music. The watch further includes at least one removable acoustic radiating membrane, which is arranged in the watch case. The removable membrane includes, in a central position, a retaining member. This retaining member is arranged with play in a housing in an inner stop member of the back cover. Owing to the cooperation between the retaining member and the stop member, the bending of the membrane is limited following excess pressure or vacuum pressure according to environmental conditions.

19 Claims, 2 Drawing Sheets

Figure 2:
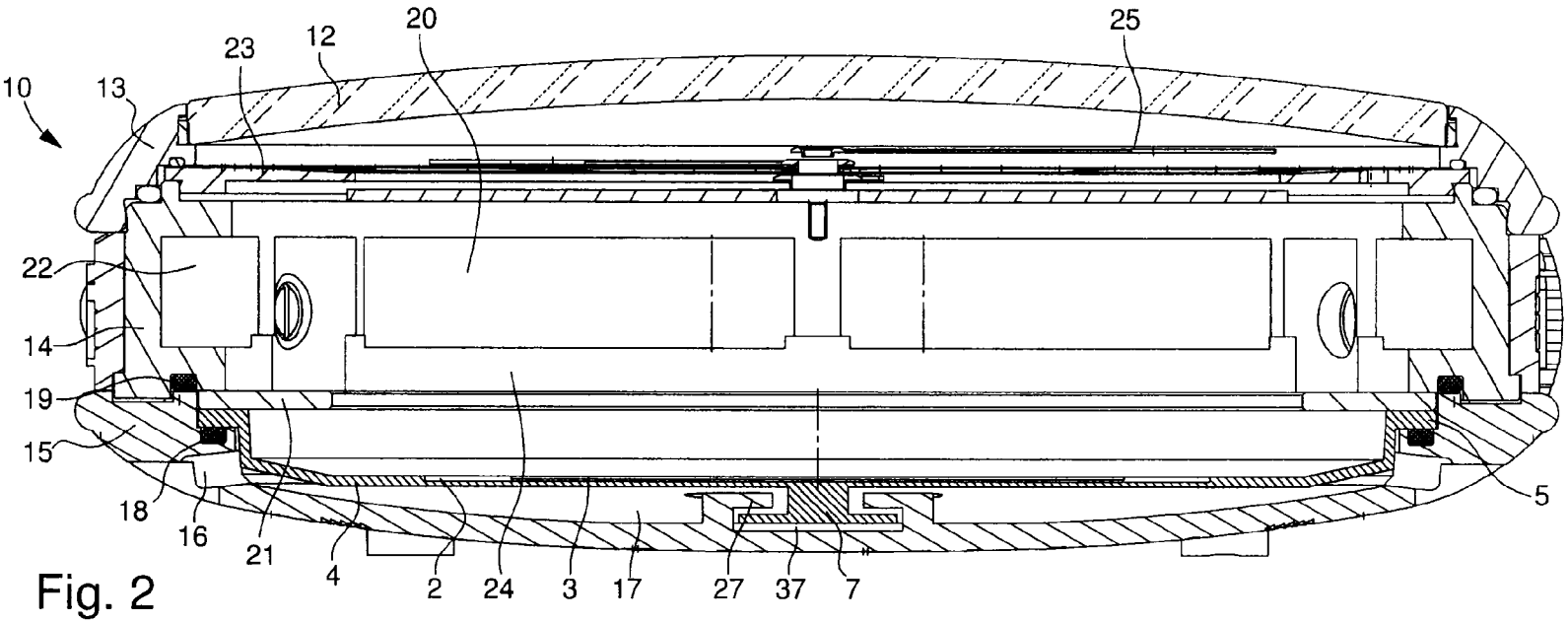

REMOVABLE ACOUSTIC RADIATING MEMBRANE FOR A MUSICAL WATCH OR STRIKING WATCH AND WATCH INCLUDING THE SAME

This application claims priority from European Patent Application No. 11159275.4 filed 22 Mar. 2011, the entire disclosure of which is incorporated herein by reference.

FIELD OF THE INVENTION

The invention concerns a removable acoustic radiating membrane for a musical watch, or a striking watch.

The invention further concerns a watch case with a middle part and a back cover between which the removable acoustic radiating membrane is held.

The invention also concerns a watch, which includes a removable acoustic radiating membrane. The watch includes a watch case essentially formed of a middle part and a back cover removably secured in a sealed manner to the middle part. A crystal is arranged on the opposite side to the back cover to close said case in a sealed manner. A timepiece movement is held inside the watch case and provided with a striking mechanism such as a musical module. This musical module is capable of being activated at determined times mainly to produce music. The removable acoustic radiating membrane is connected to the case to radiate the sound produced by the striking mechanism towards the exterior of the case.

BACKGROUND OF THE INVENTION

If the acoustic membrane is held fixed between the middle part and the back cover of the watch case, a certain number of side openings may be provided on the periphery of the back cover of the watch for transmitting sound from the vibrating membrane towards the exterior. The acoustic membrane must generally be made of a metallic material of small thickness to ensure good acoustic transmission of the sound or music generated, for example, by means of a musical module of the watch. However, with an acoustic membrane of small thickness arranged between the back cover and the watch movement, the membrane is not able to withstand significant excess pressure or vacuum pressure according to environmental conditions. These environmental conditions concern the physical conditions of the place in which the watch containing the acoustic membrane is situated. High pressure on the membrane can thus occur if the watch is used for a deep dive. In these conditions, the thin acoustic membrane is deformed and comes into contact with parts of the watch movement. This is liable to damage both the membrane and certain parts of the watch movement, which is a drawback.

One solution to this problem is disclosed in CH Patent No 375 664, which discloses a water resistant wristwatch, which includes an acoustic membrane and a means of limiting the bending of said membrane towards the interior of the watch. The circular membrane is fixed to the middle part of the watch, as the back cover, via the peripheral edge thereof. A second back cover of the case is fixed as the external part of the watch on the periphery of the membrane. This second back cover includes side openings for sound to pass through. A stop means is provided for limiting the bending of the membrane towards the interior of the watch. To achieve this, a support member is fixed in a central position on the membrane, and the centre of the second back cover includes a stop member for the membrane support member. The support member passes through an opening in the back cover at the location of the stop member to be fixed to the centre of the membrane. In the event of high external pressure, the membrane support member abuts against the stop member of the back cover to prevent the membrane from bending excessively.

One drawback of the stop means for limiting the bending of the membrane towards the interior of the watch of CH Patent No 375 664 is that the support member is fixed to the membrane by passing through an opening in the second back cover of the watch case. In these conditions, dirt can accumulate in the passage for the support member through the back cover of the case, which may greatly dampen the acoustic transmission resonance from the membrane. This may also disturb the person wearing the watch and possibly cause itching or eczema, which is another drawback. The support member may also be handled from the exterior and the membrane is not removable, which are further drawbacks.

SUMMARY OF THE INVENTION

It is thus an object of the invention to overcome the drawbacks of the aforementioned state of the art by providing a removable acoustic radiating membrane for a musical watch or a striking watch, having small thickness and means of cooperating with a watch case to prevent any significant deformation following high excess pressure or vacuum pressure once the membrane is housed in the watch case.

The invention therefore concerns a removable acoustic radiating membrane, for a musical watch or a striking watch, wherein said membrane can be removably fixed between a middle part and a back cover of a watch case, wherein it includes a retaining member intended to cooperate with a stop member of the back cover arranged entirely inside the watch case, to limit the bending of the membrane following significant excess pressure or vacuum pressure according to environmental conditions Specific embodiments of the removable acoustic radiating membrane are defined in dependent claims.

The invention therefore concerns a watch case, including at least a middle part and a back cover mounted on the middle part to close the case, wherein the back cover includes a stop member having a housing arranged entirely inside the watch case and adapted to receive a retaining member of a removable acoustic radiating membrane, wherein the membrane can be removably fixed between the middle part and the back cover of the case Specific embodiments of the watch case are defined in dependent claims.

The invention therefore also concerns a musical or striking watch, including a watch case, wherein the case has a middle part and a back cover provided with at least one side aperture, the back cover being secured in a sealed and removable manner to the middle part, a crystal closing the case in a sealed manner, a watch movement held inside the watch case and provided with a striking mechanism capable of being actuated at determined times to produce one note or several notes or music, and at least one removable acoustic radiating membrane, which is arranged in the watch case, wherein a retaining member of the membrane is arranged in a housing in a stop member of the back cover arranged entirely inside the watch case, to limit the bending of the membrane following significant excess pressure or vacuum pressure according to environmental conditions.

Specific embodiments of the watch are defined in dependent claims.

One advantage of the invention lies in the fact that the base part of the membrane is held by a retaining member in a housing in an inner stop member of the back cover. This ensures that the membrane, which is flexible and water-resistant, is not excessively deformed and does not come into contact with parts of the movement in the event of excess pressure according to environmental conditions. Mainly because the back cover includes side openings for the acoustic radiation from the membrane towards the exterior, the membrane is held at a distance from the movement by the cooperation between the retaining member and the stop member, particularly when the watch is used for diving. In normal operation, the membrane is free to vibrate, given that the retaining member is arranged in the stop member housing with play.

Since the stop member and the retaining member are made of metallic material, no significant sound damping is observed, as no joint is provided, but merely a metal-on-metal connection between the two members. No dirt can accumulate in the stop member housing, given that this stop member is made inside the watch case. Moreover, the retaining member cannot be handled once the back cover is fixed to the middle part of the watch case.

The invention therefore also concerns a method of assembling a removable membrane in a watch case according, wherein the method includes the steps consisting in:

- placing and positioning a removable membrane on the middle part,
- mounting the back cover of the case on the middle part with the inner stop member oriented so that the tongue of the retaining member of the membrane is housed in a housing of the inner stop member,
- rotating the back cover on the middle part by an angle of around 90° to arrange the length of the retaining tongue between two top catch portions of the stop member and the bottom of the housing of the back cover to achieve a bayonet assembly of the retaining member in the housing in the stop member, and
- fixing the back cover onto the middle part.

Specific steps of the method are defined in dependent claims.

BRIEF DESCRIPTION OF THE INVENTION

Figure 1:
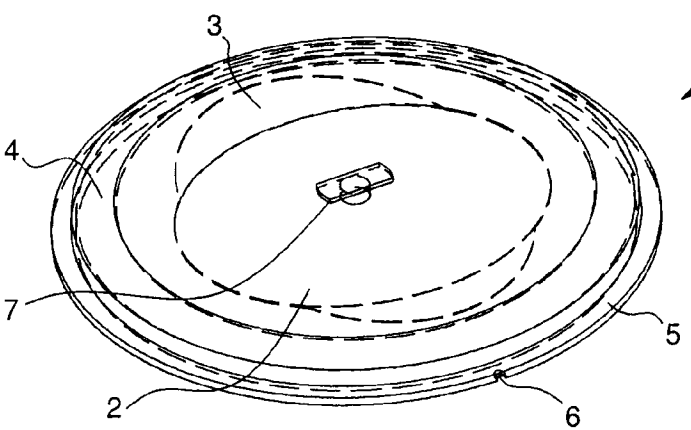
Figure 3:
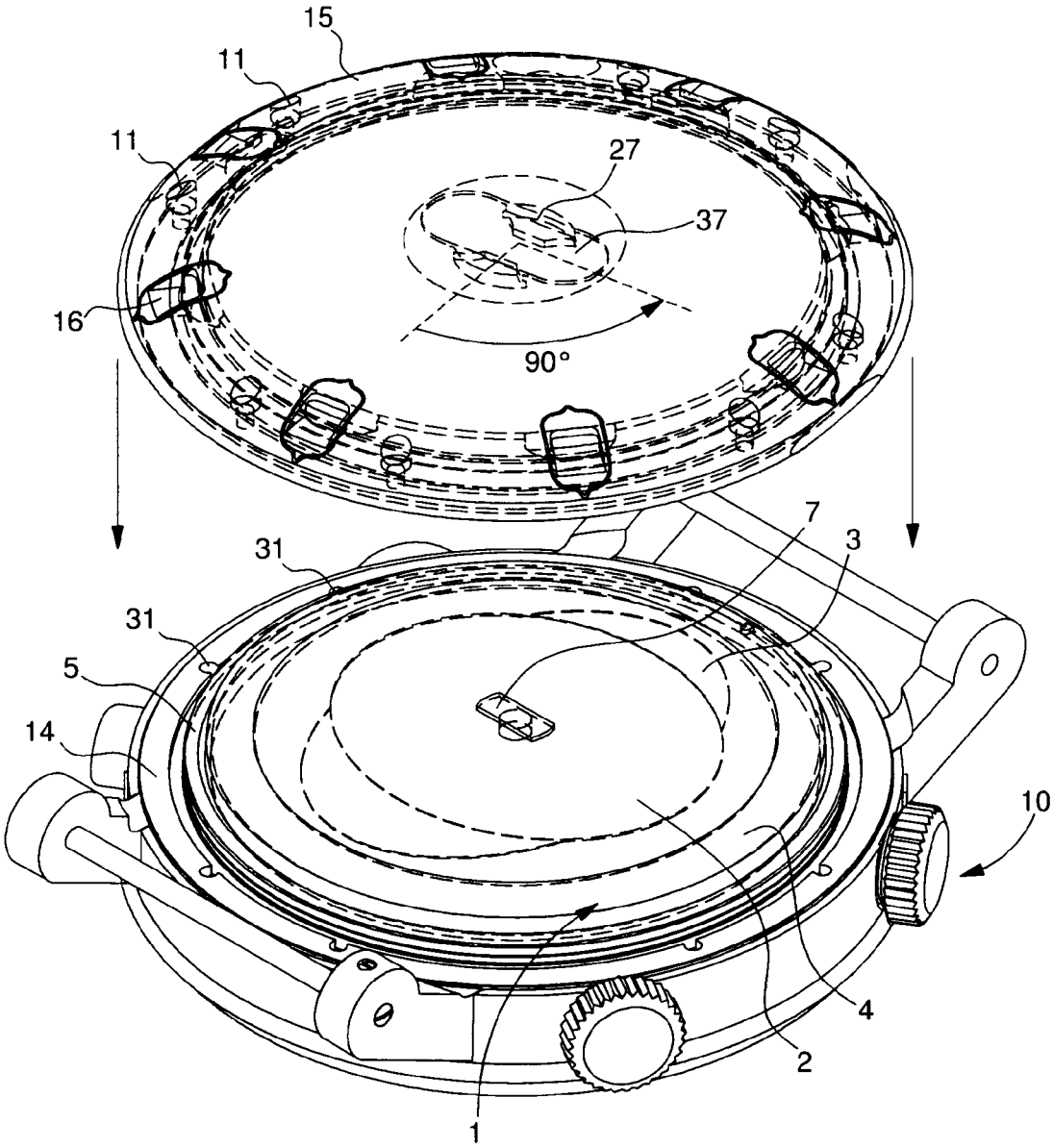

The objects, advantages and features of the removable acoustic radiating membrane for a musical or striking watch, and the watch containing said membrane will appear more clearly in the following description given on the basis of at least one non-limiting embodiment, illustrated by the drawings, in which:

FIG. 1 shows a three-dimensional bottom view of the removable acoustic radiating membrane according to the invention, FIG. 2 shows a simplified transverse cross-section of a striking or musical watch, which is provided with a removable acoustic membrane according to the invention, and FIG. 3 shows a three-dimensional bottom view of a musical or striking watch according to the invention before the back cover of the case is fixed to the removable membrane and to the middle part.

DETAILED DESCRIPTION OF THE INVENTION

In the following description, all those parts of the striking or musical watch that are well known in this technical field will be only briefly described. Reference is mainly made to the configuration of an acoustic radiating membrane and particularly how it is held in cooperation with the back cover of the watch case.

FIG. 1 shows a three-dimensional bottom view of a removable acoustic radiating membrane 1 for a musical watch, or striking watch. In this embodiment, the removable membrane may be made in the form of a dome with a base part 4 as the bottom of the dome, and a peripheral edge 5 for assembly in a watch case as explained hereinafter with reference to FIGS. 2 and 3. Membrane 1 may be a circular membrane for example having a diameter on the order of 40 mm at the edge and a diameter on the order of 31 mm in its base part 4, by way of non-limiting example. However, this membrane may also be a shape other than circular and have different dimensions.

The peripheral edge 5 of removable membrane 1 may be fixed between the middle part and the back cover of the watch case. The peripheral edge further includes a cavity 6 for receiving an indexing pin of the watch case to position membrane 1 in the watch case. The interior of the watch is sealed via the removable membrane, fixed between the middle part and the back cover of the case, but one or several side openings may be provided in the back cover of the case for the acoustic radiation from the vibrating membrane towards the exterior.

Removable membrane 1 includes a retaining member 7, which is preferably arranged in a central portion of the membrane, for example at the centre of the base part 4. Preferably, the retaining member is integral with the base part 4, although the metallic retaining member may also be screwed, driven or welded onto base part 4. Removable membrane 1 and retaining member 7 are made of a metallic material such as titanium, or precious metal such as gold, or amorphous metal.

This retaining member 7 is provided for cooperating with an inner stop member of the back cover of the watch case, as explained hereinafter with reference to FIGS. 2 and 3. When retaining member 7 is placed in a housing in the inner stop member of the back cover of the case, this limits the bending of the membrane following significant excess pressure or vacuum pressure according to environmental conditions. Generally, the membrane, arranged in a sealed manner in the watch case, is capable of withstanding high pressure when the watch is used for a deep dive.

Retaining member 7 is preferably T-shaped, but may also be L-shaped. This retaining member is thus formed of a stem fixed to the base part 4 of the membrane, and a tongue fixed to the stem parallel to base part 4. The tongue is generally rectangular, and is sized so that the width thereof allows insertion of the retaining member into the housing in the inner stop member of the back cover of the case. The length dimension of the tongue is adapted to retain the tongue in the housing following a bayonet type assembly in the back cover housing of the watch case.

To obtain good sound quality for the vibrating membrane, the thickness of the membrane must generally be small, which requires the use of retaining member 7. The general thickness of membrane 1 is 0.3 mm or less. To maximise the first natural vibration frequencies of the membrane in the frequency band between 1 kHz and 4 kHz, the membrane may be of non-homogeneous spatial thickness in the base part thereof. To achieve this, it may include at least a first area 2 of elliptic shape, formed or hollowed in the material of the membrane. This first elliptic area 2 is formed of a side opposite the side carrying the retaining member 7. The thickness of the membrane in this first elliptic area 2 may be on the order of 0.15 mm.

Removable membrane 1 may also include a second area 3 of elliptic shape formed in the material of the membrane. The thickness of the membrane in this second area is on the order of 0.2 mm. The two elliptic areas 2 and 3 are partly superposed and are of suitable dimensions to maximise the number of natural vibration modes of the member mainly within the frequency band between 1 kHz and 4 kHz. The ellipse shape is recommended in order to have two natural vibration modes compared to a circular area.

It is also to be noted that instead of making elliptic areas 2, 3 by etching, milling or hollowing into the total thickness of membrane 1, it is possible to envisage making a membrane with areas having locally modified physicochemical properties in a deterministic manner during manufacture or post treatment. This procedure allows uniform, for example elliptic areas to be made to multiply the vibration modes and flatten the frequency response.

FIG. 2 thus shows a transverse or diametral cross-section of a striking or musical watch 10. Watch 10 essentially includes a removable acoustic radiating membrane 1, which is provided with a retaining member 7 for cooperating with an inner stop member 27 of the metallic back cover 15 of the watch case. The membrane is also configured with the two elliptic areas 2 and 3 hollowed into the material of the base part 4 thereof to improve the acoustic yield of one or several notes or of music produced by a striking mechanism. This acoustic membrane may, for example, be made of amorphous metal, which may be a corrosion resistant material.

Striking or musical watch 10 also includes a watch movement 20, which is generally mounted on a plate 24. An edge part 22 is secured to plate 24, which defines a watch frame. Usually, both plate 24 and the edge part 22 are made of a metallic material.

The watch movement 20 includes a striking mechanism which is not shown. This striking mechanism may include one or several gongs mounted on the same gong-carrier integral with plate 24, and at least one or several hammers rotatably mounted on the plate for striking said gong at determined times. This striking mechanism is provided for indicating a programmed alarm time or minute repeaters.

In a more elaborate musical watch embodiment, the striking mechanism may include a musical module provided with a pin-barrel having a set of tongues connected to a heel, which is secured to plate 24. A musical note or series of notes are produced by the vibrating tongues of the pin-barrel. Each tongue is normally configured to produce one particular note, but there may be some groups of two or more tongues so that each group produces the same particular note. To produce music, for example at programmed times, the pin-barrel tongues are raised and then released by pins integral with a rotating disc or cylinder on plate 24. Each actuated tongue mainly oscillates at its first natural frequency. The vibrations generated by the actuated tongues are transmitted to the exterior parts of the watch, which must allow the sound produced by each vibrating tongue to radiate acoustically.

In this embodiment, the acoustic membrane 1 is in the shape of a dome, the peripheral top edge 5 of which is mounted, in a sealed manner via an annular gasket 18, on an inner annular edge of back cover 15 of the case. The diameter of this dome, which may be the same as the diameter of watch glass 12, may be between 20 and 40 mm. An annular shaped support 21 supports plate 24 on one side with edge part 22 and rests on the top edge of acoustic membrane 1. At the moment when metallic middle part 14 is secured to metallic back cover 15 of the watch case, support 21 and the peripheral edge of acoustic radiating membrane 1 are clamped between middle part 14 and the edge of back cover 15.

It is to be noted that acoustic membrane 1 may be fixed via the edge 5 thereof in a different manner to that described hereinbefore. The membrane could be fixed at 2, 3, 4 or more of points via the edge thereof, or elastically fixed or with a simple bearing condition.

Back cover 15 is removably mounted by known means on middle part 14 with a sealing gasket 19. Back cover 15 may be fixed to the middle part by means of screws as explained hereinafter with reference to FIG. 3. A watch crystal 12 is secured notably to bezel 13 to close the watch case in a sealed manner. A dial 23 is held on the edge of the middle part and arranged below watch crystal 12. For a mechanical striking watch 10, time indicating hands 25 are provided on the dial, which generally carries hour symbols on the periphery thereof.

In normal operating mode, the central part 4 of the acoustic membrane is not in contact with support 21 and the inner surface of back cover 15. Consequently, a sufficient space 17 is provided in the case for the acoustic membrane to be able to vibrate freely or radiate acoustically. Acoustic membrane 1 and back cover 15 thus together form a double back cover. One or several apertures 16 are also provided laterally through back cover 15 to allow the acoustic membrane to radiate the sound produced by the striking mechanism towards the exterior.

However, in the event of any significant excess pressure or vacuum pressure on the membrane, retaining member 7, which is arranged with play in a housing 37 in inner stop member 27 of the back cover, may come into metal-on-metal contact with the inner stop member 27 of the back cover. The cooperation between retaining member 7 and inner stop member 27 prevents the membrane from undergoing significant deformation when the watch is used for a deep dive. The play that retaining member 7 is allowed in housing 37 in inner stop member 27 may be estimated, for example, at a maximum of 0.5 mm on each side of the tongue and stem of retaining member 7.

During operation of the striking mechanism, the note or notes produced by said striking mechanism are transmitted straight to the removable acoustic radiating membrane to make it vibrate. Connecting parts 21, 22 and 24 also transmit vibration to the acoustic membrane 1 at the edge thereof. Since the acoustic membrane includes asymmetrical areas in the form of ellipses 2, 3 hollowed into the base part 4 of the membrane, it is capable of vibrating at several first natural frequencies according to the number of notes to be radiated. These first natural frequencies are preferably within the useful acoustic frequency band between 1 kHz and 4 kHz. The second natural vibration frequencies of the notes are, however, higher than 4 kHz. This is advantageous as the second vibration frequencies are often sound destructive.

These desired natural acoustic vibration frequencies of the membrane, which may be made of amorphous metal, are dependent upon physical properties, such as density and the Young's modulus. The amorphous metal used may be for example a titanium, zirconium and beryllium based metal alloy. Moreover, with this type of acoustic radiating membrane 1, a very low level of damping is observed, which provides the acoustic membrane with a very high level of acoustic efficiency.

Owing to the fact that this removable membrane 1 can be formed of corrosion resistant materials, it can be mounted on a back cover 15, made, for example, of precious metal, such as gold. There is no difference in electrochemical potential observed even in a humid environment, which means that no corrosion occurs on contact between membrane 1 and back cover 15.

FIG. 3 shows a three-dimensional bottom view of a musical or striking watch 10 according to the invention before the back cover of the case has been fixed to removable membrane 1 and to middle part 14. The steps of assembling the removable acoustic membrane 1 in a watch case 14, 15 are mainly shown.

The peripheral edge 5 of the removable acoustic membrane 1 is arranged on the periphery of a support of the watch movement (not shown). The membrane is positioned by an indexing pin (not shown) of the watch case. The membrane has a cavity on the periphery thereof for receiving said pin. The retaining member 7 of the membrane is positioned in this view with the tongue parallel to the base part 4, and the length thereof is arranged in the 3 o'clock-9 o'clock direction of the watch. The position of elliptic areas 2 and 3, which are hollowed into the material of the membrane on the watch movement side, will also be noted. However, these elliptic areas 2 and 3 may also be made on the same side as retaining member 7.

On an inner side of the watch, metallic back cover 15 has a stop member 27. This inner stop member 27 is formed of two hook-shaped catches, which are opposite each other. Each catch has a side wall perpendicular to back cover 15 and a top portion substantially parallel to back cover 15. The side walls and the top portions of the two catches define the housing 37 for holding retaining member 7 of the removable membrane by a bayonet assembly as explained. Housing 37 is of course sized to allow play for retaining member 7 of the membrane to move once positioned in said housing 37.

The metallic back cover 15 is first of all placed on middle part 14 as shown by the arrows, while ensuring that the two catches of stop member 27 are oriented so that the width of the tongue of retaining member 7 passes between the two catches right into housing 37. Once this operation is completed, back cover 15 is turned by an angle of around 90° so that the length of the tongue is between the top portions of the catches of stop member 27 and the bottom of housing 37. This defines a bayonet type assembly.

Once the bayonet assembly of retaining member 7 in housing 37 of stop member 27 is completed, back cover 15 can be screwed onto the middle part via screws (not shown), which each pass through a corresponding notched opening 11 in the back cover, and are screwed into threads 31 in the middle part 14. The peripheral edge 5 of removable membrane 1 is thus held pressed between the movement support and the back cover 15 via a sealing gasket 18 shown in FIG. 2. The watch movement is held in a sealed chamber due to the membrane secured between middle part 14 and back cover 15. Side apertures 16 in the back cover are provided for the acoustic radiation from the membrane. It is also through these apertures 16 that the membrane can undergo significant pressure according to environmental conditions, particularly when the musical watch is used for diving. However, the bending of the membrane is limited by the cooperation between retaining member 7 and stop member 27 as mentioned above.

From the description that has just been given, several variants of the removable acoustic radiating membrane for a musical watch or striking watch, and the musical watch or striking watch can be devised by those skilled in the art without departing from the scope of the invention defined by the claims. The retaining member of the membrane may be arranged in an off-centre position relative to the centre of the membrane. Several retaining members may be provided, which each cooperate with a specific stop member inside the watch case. The membrane may have a shape other than circular, for example rectangular, or it may be flat. The membrane may include an area of elliptic shape on a first face and another area of elliptic shape on a second opposite face of the membrane. The stop member may be a closed portion defining a housing for receiving a tongue of the L-shaped retaining member. The retaining member may also have a helical shape.

What is claimed is:

1. A removable acoustic radiating membrane for a musical watch or a striking watch, wherein the membrane can be removably fixed between a middle part and a back cover of a watch case, the membrane comprising:

a retaining member that, when positioned between the middle part and the back cover of the watch case, cooperates with an inner stop member of the back cover arranged entirely inside the watch case, to limit bending of the membrane following significant excess pressure or vacuum pressure according to environmental conditions, the retaining member being T or L-shaped with a stem fixed to a base part of the membrane and a tongue fixed to the stem parallel to the base part, wherein the tongue is rectangular, a width of the tongue being sized for insertion thereof in a housing in the inner stop member of the back cover of the watch case, and a length of the tongue being sized to retain the tongue in the housing following a bayonet type assembly in the housing.

2. The membrane according to claim 1, wherein the retaining member is arranged in a central part of the membrane.

3. The membrane according to claim 1, wherein the retaining member is integral with the base part of the membrane.

4. The membrane according to claim 1, wherein a thickness of the membrane is 0.3 mm or less.

5. The membrane according to claim 4, wherein the membrane further comprises at least a first area of elliptic shape formed in a material of the membrane, and wherein the thickness of the membrane in the first area is approximately 0.15 mm.

6. The membrane according to claim 5, wherein the membrane further comprises a second area of elliptic shape formed in the material of the membrane, wherein the thickness of the membrane in the second area is approximately 0.2 mm, and wherein the the first and second areas are partly superposed so as to maximize first natural vibration frequencies of the membrane in a frequency band between 1 kHz and 4 kHz.

7. The membrane according to claim 1, wherein the membrane is made of precious metal or titanium or amorphous metal.

8. The membrane according to claim 1, wherein the membrane has a dome shape with a base part, on which the retaining member is fixed, and a peripheral edge for assembly between the middle part and the back cover of the watch case.

9. The membrane according to claim 1, wherein a peripheral edge of the membrane includes a cavity for receiving a watch case indexing pin to position the membrane in the watch case.

10. A watch case, comprising:

a middle part; and a back cover mounted on the middle part to close the case, the back cover including an inner stop member having a housing arranged entirely inside the watch case and adapted to receive a retaining member of a removable acoustic radiating membrane according to claim 1, wherein the membrane can be removably fixed between the middle part and the back cover of the case, and wherein the inner stop member includes two hook-shaped catches opposite each other, each catch having a side wall and a top portion to define the housing between the two catches to enable the retaining member of the removable membrane to be held via a bayonet assembly.

11. The watch case according to claim 10, wherein the housing between the two catches is sized to allow for movement of the retaining member of the removable membrane.

12. The watch case according to claim 10, wherein the back cover includes one or more side apertures for radiation of at least one sound generated in the watch case towards an exterior side of the watch case.

13. A musical or striking watch, comprising:

a watch case including a middle part, and a back cover having at least one side aperture, the back cover being secured in a sealed and removable manner to the middle part;

a crystal closing the case in a sealed manner;

a watch movement held inside the watch case and provided with a striking mechanism that is actuable at determined times to produce one note or several notes or music; and at least one removable acoustic radiating membrane according to claim 1, which is removably fixed between the middle part and the back cover of the watch case.

14. The watch according to claim 13, wherein the retaining member is T-shaped, and wherein the inner stop member includes two hook-shaped catches opposite each other, each catch having a side wall and a top portion to define the housing between the two catches to enable the retaining member of the removable membrane to be held following a bayonet assembly.

15. The watch according to claim 13, wherein the acoustic membrane is held on an inner edge of the back cover of the case and one portion of the middle part, and wherein a periphery of the acoustic membrane is clamped with a periphery of an annular support of a movement between the middle part and the inner annular edge of the back cover of the case.

16. The watch according to claim 15, wherein the acoustic membrane has a dome shape, a top edge of the dome shape being clamped with the annular support between the middle part and the inner annular edge of the back cover of the case, an annular sealing gasket being placed between the inner annular edge of the back cover and an annular edge of the membrane, and wherein a central part of the acoustic membrane is not in contact with the annular support and an inner surface of the back cover of the case to define a space in which the membrane can oscillate freely.

17. A method of assembling a removable acoustic radiating membrane according to claim 1 in the watch case, the method comprising:

placing and positioning the removable membrane on the middle part;

mounting the back cover of the case on the middle part with the inner stop member oriented so that the tongue of the retaining member of the membrane is housed in the housing of the inner stop member;

rotating the back cover on the middle part by an angle of around 90° to arrange the length of the tongue between two top catch portions of the inner stop member and a bottom of the housing of the back cover to achieve a bayonet assembly of the retaining member in the housing in the inner stop member; and fixing the back cover onto the middle part.

18. The method according to claim 17, wherein the back cover is fixed onto the middle part via screws, each screw passing into a corresponding notched aperture in the back cover, and each screw screwed into a respective thread in the middle part.

19. The method according to claim 17, wherein the membrane is oriented on the middle part via a peripheral cavity that is able to receive an indexing pin of the watch case.

* * * * *